US009777517B2

(12) United States Patent
Scholz et al.

(10) Patent No.: US 9,777,517 B2
(45) Date of Patent: Oct. 3, 2017

(54) LOCK FOR A PANEL OR DOOR

(71) Applicant: Kiekert Aktiengesellschaft, Heiligenhaus (DE)

(72) Inventors: Michael Scholz, Essen (DE); Armin Handke, Duisburg (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 172 days.

(21) Appl. No.: 14/383,922

(22) PCT Filed: Feb. 16, 2013

(86) PCT No.: PCT/DE2013/000085

§ 371 (c)(1),
(2) Date: Dec. 22, 2014

(87) PCT Pub. No.: WO2013/131502

PCT Pub. Date: Sep. 12, 2013

(65) Prior Publication Data

US 2015/0167363 A1 Jun. 18, 2015

(30) Foreign Application Priority Data

Mar. 9, 2012 (DE) ..... 10 2012 203 734

(51) Int. Cl.
*E05C 3/06* (2006.01)
*E05B 85/20* (2014.01)
(Continued)

(52) U.S. Cl.
CPC ..... *E05B 85/20* (2013.01); *E05B 85/26* (2013.01); *E05B 77/34* (2013.01); *Y10T 292/108* (2015.04)

(58) Field of Classification Search
USPC ..... 292/200
See application file for complete search history.

(56) References Cited

U.S. PATENT DOCUMENTS 5,676,003 A * 10/1997 Ursel ..... E05B 77/26 292/201
6,435,573 B1 * 8/2002 Szablewski ..... E05B 81/14 292/201
(Continued)

FOREIGN PATENT DOCUMENTS

DE 4119703 C1 10/1992
DE 102007003948 A1 5/2008
(Continued)

OTHER PUBLICATIONS

Machine translation by Lexis Nexis Total Patent for DE102007003948A1 on Sep. 4, 2014.
(Continued)

*Primary Examiner* — Mark Williams
(74) *Attorney, Agent, or Firm* — Woodard, Emhardt, Moriarty, McNett & Henry LLP

(57) ABSTRACT

The aim of the invention is to provide a reliably functioning lock for a motor vehicle in particular. This is achieved in that the claimed lock for a door or a panel has a locking mechanism consisting of a rotary latch and at least one pawl for locking the rotary latch. The rotary latch and the pawl are preferably designed such that the rotary latch is capable of introducing an opening torque into the pawl. The locking mechanism has a triggering lever for opening the locking mechanism. A transmission device is further provided which increases the pivotal movement of the triggering lever and which comprises a transmission lever in particular for moving the pawl out of the locking position of the pawl by means of a follower. On the basis of the pivotal movement transmission caused by the transmission lever, a relatively small pivotal movement of the triggering lever is sufficient to move the pawl completely out of the locking position by means of the follower. The invention thus ensures that a locking mechanism can be reliably opened even when the triggering lever can no longer be pivoted over the entire original distance due to the effects of aging.

20 Claims, 1 Drawing Sheet

(51) Int. Cl.
*E05B 85/26* (2014.01)
*E05B 77/34* (2014.01)

(56) References Cited

U.S. PATENT DOCUMENTS

| | | | | |
|---|---|---|---|---|
| 6,883,839 | B2 * | 4/2005 | Belmond | E05B 77/12 292/201 |
| 2003/0218340 | A1 * | 11/2003 | Coleman | E05B 77/06 292/169.11 |
| 2010/0237632 | A1 | 9/2010 | Browne | |

FOREIGN PATENT DOCUMENTS

| | | | |
|---|---|---|---|
| DE | 102008034638 | A1 | 1/2010 |
| DE | 102010003491 | A1 | 1/2011 |
| GB | 2480860 | A | 12/2011 |

OTHER PUBLICATIONS

Machine translation by Lexis Nexis Total Patent for DE102008034638A1 on Sep. 4, 2014.
Machine translation by Lexis Nexis Total Patent for DE102010003491A1 on Sep. 4, 2014.
Machine translation by Lexis Nexis Total Patent for DE4119703C1 on Sep. 4, 2014.

* cited by examiner

LOCK FOR A PANEL OR DOOR

REFERENCE TO RELATED APPLICATIONS

This application is the U.S. national stage application of International Patent Application No. PCT/DE2013/000085, filed Feb. 16, 2013, which claims priority of German Application No. 10 2012 203 734.9, filed Mar. 9, 2012, which are hereby incorporated by reference.

The invention relates to a lock for a panel or a door with the characteristics of the generic term of claim 1. The door or panel can be a door or panel of a motor vehicle or of a building.

Said lock has a locking mechanism consisting of a rotary latch and at least one pawl for locking the rotary latch in a closed position. In a closed position the rotary latch can retain a locking pin of a door or of a panel so that the door or panel cannot be opened. If the rotary latch is in an open position, the locking pin leaves the locking mechanism and the door or panel can be opened.

Publication DE 10 2010 003 483 A1 discloses a locking mechanism in which the rotary latch introduces an opening torque into the pawl when the pawl locks the rotary latch in the main catch position. The rotary latch can, for instance, as a result of a door sealing pressure and/or a pretensioned spring, which can turn the rotary latch to its opening position and/or by opening a respective door or panel, introduce such a torque into the pawl. An opening torque can move the pawl out of its detent position. In order to reliably prevent this in case of a locked locking mechanism, a blocking lever is provided which can block the pawl from being moved out of its detent position. In order to open such a locking mechanism, the blocking lever is pivoted out of its blocking position with the aid of a triggering lever. In case of a lock it can suffice to pivot the triggering lever, for instance, by only 9° to move the blocking lever out of its blocking position. Generally, the opening torque introduced by the rotary latch into the pawl then suffices to disengage or open the locking mechanism.

Dust, tolerances in the activation chain of the locking mechanism and/or of the triggering lever and/or insufficient pressure from the door seal rubber can cause no or an insufficient torque to be introduced by the rotary latch into the pawl in order to release the pawl from the rotary latch and open the locking mechanism. In this case, an additional force must be introduced on the associated door or panel, in order to overcome the static friction between the rotary latch and pawl or to open the door.

In order to ensure that the locking mechanism is also released in case of insufficient opening torque being introduced into the pawl, a follower is provided which is, for instance, arranged on the triggering lever and/or as disclosed in DE10 2010 003 483 A1, is arranged on an intermediate catch pawl disclosed in the publication. Such a follower has the task of, in particular, pivoting the pawl out of its detent position when the pawl is unable to leave the detent position solely as a result of the applied opening torque.

In order for the locking mechanism to be opened by the follower, the follower provided, for instance on the triggering lever must be able to be pivoted across a sufficiently large angle. In general, an angle of up to 20°, in particular up to 30°, for instance approx. 12° suffices for the follower to move a pawl alone out of its detent position.

A triggering lever of a locking mechanism is generally pivoted as a result of an activation of a handle. The handle can be an internal or external door handle of a vehicle. Such a handle is generally connected to the triggering lever by means of rods or a Bowden cable in order to pivot the triggering lever by activating the handle. If the tolerances increase over the service life of the lock or if the rods or Bowden cable becomes loose, the pivoting range can be reduced around which the triggering lever can be pivoted by activation of a handle. As a result of such ageing it can occur that a lock can no longer be opened. In other words, the triggering lever can release the blocking lever of the pawl, but the pivot angle of the triggering lever does no longer suffice to mechanically move the pawl out of the engagement area of the rotary latch. In this case it can, for instance, occur that due to dust between the contact surfaces of the rotary latch and the pawl, the locking mechanism does no longer open by itself. In order to open the lock or to disengage the locking mechanism it is then necessary to apply an additional force onto the lock. An additional force can, for instance, be applied to the lock by pulling or pushing on the door.

It is the task of the invention to provide a reliably functioning lock of the aforementioned type.

The task of the invention is solved by a lock with the characteristics of the first claim. Advantageous embodiments are described in the sub-claims.

In order to solve the task, the lock of the invention used for a door or panel and preferably for a motor vehicle or a building contains a locking mechanism comprising a rotary latch and at least one pawl for locking the rotary latch. The rotary latch and pawl are preferably designed in such a way that the rotary latch can introduce an opening torque into the pawl.

The locking mechanism contains a triggering lever for opening the locking mechanism. In addition, a transmission device is provided, increasing the pivot movement of the triggering lever, including in particular a transmission lever for moving the pawl out of its detent position, in particular, by means of a follower.

Due to the transmission of the pivot movement caused by the transmission lever, a relatively small pivoting movement of the triggering lever suffices to move the pawl fully out of its detent position, in particular with the aid of the follower. In this way it is ensured that a locking mechanism can also be still reliably opened if the triggering lever can no longer be pivoted along the entire original distance as a result of ageing.

In one embodiment of the invention, the transmission device increases the rotary movement of the triggering lever in such a way that a rotary movement of the triggering lever of up to 20°, preferably up to 16° and particularly preferably up to 14° such as 13.5° suffices to move the pawl fully out of its detent position with the aid of the follower. In one embodiment of the invention a rotary movement of the triggering lever of at least 8°, and preferably of at least 10° and particularly preferably up to 12° are required to move the pawl out of its detent position with the aid of the follower.

In order to suitably increase the pivoting movement, one embodiment of the triggering lever contains two lever arms, a short lever arm and a comparatively long lever arm, which can be pivoted around a common axis. The triggering lever can pivot the free end of the lever arm in such a way that the pawl can be pivoted out of its detent position with the aid of the long lever arm. Preferably, the long lever arm is at least 1.5 times longer than the short lever arm in order to be able to suitably increase the pivoting movement. Preferably the long lever arm is not more than 2.5 times longer than the shorter lever arm in order to optimize the required space and keep the force required for moving the pawl out of its detent position low enough. The long lever arm or its end serves as a follower for the pawl In order to achieve a favourable transmission ratio, the lever arm of the triggering lever, which is able to move the lever arm of the transmission lever, is in one embodiment long in comparison to said lever arm of the transmission lever. Said lever arm of the triggering lever is preferably at least 1.5 times as long as said lever arm of the transmission lever. It is sufficient for said lever arm of the transmission lever to be not more than 2.5 times as long as said lever arm of the transmission lever, in order to keep the required installation space to a minimum.

The lever arm of the transmission lever that is able to move the pawl, is preferably long in comparison to the lever arm of the pawl moved by the transmission lever, in order to achieve a favourable transmission ratio. Preferably, this lever arm of the transmission lever is at least 1.5 times as long as the lever arm of the pawl. Preferably, said lever arm of the transmission lever is not more than 2.5 times as long as this lever arm of the pawl.

When in context of the transmission ratio reference is made to the length of a lever arm this refers to the section of an arm, physically acting as a lever in this arrangement. The actual length of an arm can therefore be longer than the physically acting lever arm.

In one embodiment the long and short lever arm of the transmission lever form an acute angle preferably smaller than 40° and particularly preferably smaller than 30° in order to provide the transmission lever within a small space.

In one embodiment, the transmission lever comprises three lever arms. Two lever arms i.e. a longer and a comparative shorter lever arm provide the transmission, in order to move the pawl out of its detent position with the aid of the transmission. The third lever arm is provided for moving the pawl into its detent position or at least for assisting such a movement. When a lock is closed very quickly, for instance when a respective door or panel of a motor vehicle is slammed shut whilst another door or panel is still open, it can happen that the rotary latch opens again before the pawl engages in the main catch. This is referred to as bouncing, resulting in the door opening again. Such bouncing can be prevented by the third lever arm if it at least assists the movement of the pawl into its detent position.

In one embodiment, the two outer lever arms between which one of the three lever arms is positioned form an acute angle preferably smaller than 40° and particularly preferably smaller than 30° in order to provide a compact transmission lever. As a result, all lever arms form an acute angle in relation to each other.

In one embodiment of the invention, the lever arm preventing the bouncing rests against the pawl, if it is in its engaged position and if the locking mechanism is locked. Preferably the lever arm preventing the bouncing rests against the pawl close to the end of the lever located at the axle of rotation in order to accommodate the arrangement in a compact space. The distance between the free end of the lever arm preventing the bouncing and the free end of the lever arm of the pawl not directly serving to engage the rotary latch, is in this case larger than the distance between the pivot point of the pawl and the free end of the lever arm preventing the bouncing. The length of the lever arm of the triggering lever is, in particular, longer than the length of the lever arm of the triggering lever on which the lever arm of the triggering lever acts in order to prevent bouncing. Again the physically effective lever lengths matter. Although due to less favourable lever forces, the force preventing bouncing is relatively small, not a lot of force is required as only the bouncing has to be prevented. It is therefore preferable to rather provide a compact design than a considerable force.

Preferably a spring is provided, which is able to move the lever arm of the transmission lever preventing the bouncing, in the direction of the pawl in order to particularly reliably prevent bouncing.

In order to provide a compact design consisting of only a few parts, the pawl and triggering lever of the locking mechanism are in one embodiment pivotally mounted on a common axis.

Advantageously the rotary latch is pretensioned by a spring in the direction of the opening position so that said latch can be pivoted into the open position solely by the force of the spring and in order to introduce an opening torque into the pawl even without a door sealing pressure.

In one embodiment of the invention the triggering lever can move a blocking lever of the locking mechanism out of its blocking position. Generally, relative little force is required for this. If the pawl is then moved out of its detent position because of an opening torque applied by the rotary latch on the pawl, advantageously very little force is required to open the locking mechanism.

In one embodiment a spring is provided for moving the blocking lever into its blocking position. The blocking lever can be simply and reliably moved into its blocking position by the spring. In one embodiment, the blocking lever and pawl are designed in such a way that by moving the blocking lever into its blocking position the pawl is at the same time moved into its detent position. This reduces the number of parts required to a minimum as well as the weight and the required space.

In one embodiment, the triggering lever comprises three lever arms. A first lever arm, in particular, serves to move a blocking lever out of its blocking position to unlock the locking mechanisms. The second lever arm of the triggering lever serves to pivot the transmission lever. The third lever arm pivots the triggering lever, for instance with the aid of a rod mechanism or Bowden cable as well as preferably with the aid of a handle connected therewith and/or an electrical drive. If the handle is activated or the electrical drive is started, the third lever arm is pivoted in order to open the locking mechanism.

Advantageously also a stop is provided, in particular to reduce space to a minimum as well as the weight for the second lever arm in order to prevent the triggering lever being moved further than a desired end position.

In one embodiment, one lever arm of the triggering lever, in particular the first lever arm, can lock the rotary latch in the intermediate catch position. In this embodiment, the rotary latch can contain a protruding pin or arm, serving to lock the rotary latch in the intermediate catch position.

The pawl preferably contains two lever arms, preferably forming an angle smaller than 180° and/or larger than 90°. The rotary latch is locked by a lever arm. A mechanism such as, for instance, a pretensioned spring acts on the other lever arm in order to be able to move the pawl with the aid of the mechanism, for instance a pretensioned spring, into its detent position. This other lever arm of the pawl is preferably engaged by the follower of the triggering lever to unlock the locking mechanism and is moved accordingly and is, in particular, pivoted around an axis. Advantageously the embodiment also contains a stop for the other lever arm in order to prevent the pawl from being moved further than its complete detent position.

A blocking lever for blocking the pawl in its engaged position contains preferably two lever arms. A first lever arm of the blocking lever can, in particular, block the pawl in its locked position and/or move the pawl into its locked position. In one embodiment this first lever arm can, in particular, advantageously also be engaged by the triggering lever and moved out of its blocking position and, in particular, pivoted around an axis. The second lever arm of the blocking lever can preferably be moved against a stop in order to prevent the blocking lever from being moved further than a provided end position. The provision of a second lever arm also contributes advantageously to the centre of gravity of the blocking lever being moved in the direction of the axis, around which the blocking lever can be pivoted. This movement of the centre of gravity facilitates the pivoting of the blocking lever. In one embodiment of the invention, both lever arms of the blocking lever in turn form an angle larger than 90° and/or smaller than 180°.

In one embodiment, the follower is able to move the pawl completely out of its detent position only causes the pawl to be moved out if the pawl does not move out of the detent position by itself as a result of an opening torque. This embodiment contains a clearance through which the follower must move before it can engage with and move the pawl. When, in this embodiment, a blocking lever is moved out of its blocking position, the pawl is generally moved out of its detent position by the opening torque applied by the rotary latch onto the pawl. Only if this mechanism fails does the follower engage the pawl after having passed through the clearance, moving it out of its detent position.

In one embodiment, the triggering lever is also an intermediate catch pawl that can lock the rotary latch in the intermediate catch position. The locking mechanism can in this case lock a door or panel. It is, however, then not as yet locked as planned in the main catch position. The main catch position is only reached from the intermediate catch position if the rotary latch is pivoted further in the direction of the locked position.

A locking mechanism of the invention is, in particular, mounted on a lock plate generally made of metal or on a lock case, generally made of metal. Usually, such a lock also contains a lock housing generally made of plastic and which protects components of the lock on the outside. In addition a lock lid made, in particular, of plastic and/or a lid for the central locking, made in particular of plastic, can be provided also protecting the components. The lock can, for instance, be part of a door or a panel of a building or of a door or panel of a motor vehicle.

The invention also includes a lock with a pawl for the main catch position of the rotary latch (also referred to as "main catch pawl"), a pawl for the intermediary catch position of the rotary latch (also referred to as "intermediate catch pawl") and preferably a blocking lever for said main catch pawl. Such a lock is disclosed in publication DE 10 2008 061 524 A1. A lock according to the invention can, however, in addition to the blocking lever, also contain a pawl for locking the rotary latch in an "intermediate catch position" and in a "main catch position".

The rotary latch has a fork-like intake slot, entered by a locking pin of a door or of a panel when the motor vehicle door or motor vehicle panel is closed. In this case, the locking pin pivots the rotary latch from an opening position into a detent position. In the detent position the locking pin can no longer leave the intake slot of the rotary latch. The pawl locks the rotary latch in the detent position so that it can no longer be moved back into the open position.

A lock according to the invention includes components such as pawl, blocking lever or rotary latch that can and must be pivoted. Usually the lock contains at least one pretensioned spring, in particular a leg spring with the aid of which the desired pivoting movement of such a component can be produced by the force of the spring. Such a pretensioned spring can, for instance, move a pawl into its detent position, move a blocking lever into its blocking position or a rotary latch into its open position.

The rotary latch, pawl and blocking lever can be arranged on a lowest plane, in particular next to a lock plate, preferably made of metal or a lock case, made of metal. The transmission lever can be arranged on a plane situated between the lowest plane and the plane in which the triggering lever is arranged. Other arrangements are, however, also possible.

EXPLANATION OF DRAWINGS

FIG. 1 shows a locking mechanism comprising a rotary latch 1, a pawl 2, a blocking lever 3 and a triggering lever 4. The rotary latch 1 can be pivoted around its own axis 5. The pawl 2 and the triggering lever 4 can be pivoted around their common axis 6. The blocking lever 3 can be pivoted around its axis 7. The rotary latch 1, the pawl 2 and the blocking lever 3 are located on a common plane. The triggering lever 4 is located on another, second plane.

The locking mechanism also includes a transmission lever 8 with three lever arms 9, 10 and 11. The transmission lever 8 can be pivoted around its axis 12. The transmission lever 8 is located on a further, third plane. The three lever arms 9, 10 and 11 form an acute angle between themselves. This also applies to the outer lever arms 10 and 11. A lever arm starts at the rotation point of the axis 12 and ends in the end area that can rest against another component as described below.

Figure 1:
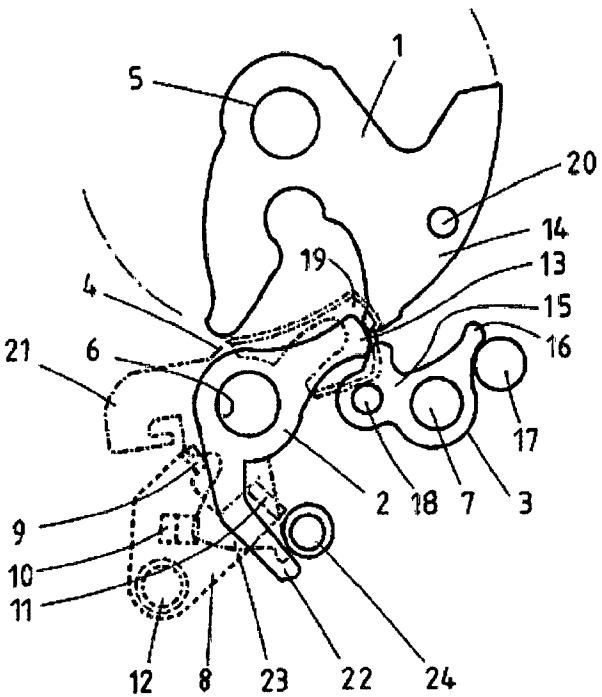
FIG. 1: shows a locking mechanism in the main catch position.

FIG. 1 shows the locking mechanism in the main catch position. The lever arm 13 of the pawl 2 rests against the engaging arm or main detent arm 14 of the rotary latch 1 thus preventing the rotary latch 1 from being moved in clockwise direction towards the open position. The engaging arm 14 of the rotary latch 1 rests against the lever arm 13 in such a way that an opening torque is introduced into the pawl 2. A lever arm 15 of the blocking lever 3 blocks the lever arm 13 of the pawl 2, preventing the pawl 13 form being moved out of its detent position in clockwise direction as a result of the opening torque. In this blocking position the lever arm 16 of the blocking lever 3 rests against stop 17, thus preventing the blocking lever 3 from being pivoted in clockwise direction past its blocking position. Preferably, the arrangement contains a spring—not shown—which is pretensioned and which can move the blocking lever 3 in the direction of the blocking position.

The lever arm 15 is, in particular, formed in such a way and can rest against the side of the lever arm 13 of the pawl 2 in such a way that the lever arm 15 pivots the lever arm 13 of the pawl 2 into its detent position when the blocking lever 3 is moved into its blocking position. Alternatively or in addition, a pretensioned spring is provided—not shown—which is able to move the pawl 2 into its detent position.

A pin 18 protrudes from the blocking lever 3 in the direction of the second plane. A lever arm 19 of the triggering lever 4 can be pivoted in clockwise direction in such a way that it catches the pin 18 so that the blocking lever 3 can be pivoted out of its blocking position. The lever arm 19 also serves to lock the rotary latch 1 in the main catch position. The rotary latch 1 contains a pin 20 protruding in the direction of the second plane and which rests against the lever arm 19 in the intermediate catch position. The triggering lever 4 is thus also an intermediary catch pawl.

A rod mechanism or a Bowden cable is, for instance, connected to the lever arm 21 of the triggering lever 4 in such a way so that the triggering lever 4 can be pivoted to open the locking mechanism in clockwise direction. By actuating the handle, the locking mechanism is opened.

The end of the lever arm 11 of the transmission lever 8 extends into the first plane and contains a small gap to the lever arm 22 of the pawl 2 as clearance in the main catch position. This end of the lever arm 11 serves as follower to move the pawl 2 out of its detent position, if the pawl is not moved out of its detent position by the opening torque. The lever arm 11 is approx. 1.8 times longer than the lever arm 10. If the locking mechanism is opened, the lever arm 23 of the triggering lever 4 catches the end of the lever arm 10 and pivots the transmission lever 8 as a result in counter clockwise direction and preferably against the spring force of a pretensioned spring. As the lever arm 11 is longer than the lever arm 10, a transmission is achieved so that a small pivoting movement of the triggering lever 4 of only 13.5° already suffices to fully move the pawl 2 out of its detent position, where required, with the aid of the followers 11.

In the main catch position the end of the lever 9, extending into the first plane, rests against the lever arm 22 of the pawl 2 and can thus support the movement of the pawl 2 into its detent position. Bouncing of the pawl 2 during closing of a door or of a panel can thus be prevented.

In the main catch position a gap can be provided between the lever arm 23 of the triggering lever 4 and the end of lever 10, in order to alternatively or in addition provide the clearance for the follower 11.

FIG. 1 shows a stop 24 against which the lever arms 22 and 23 can be moved in order to prevent excessive pivoting in counter clockwise direction by the triggering lever 4 and pawl 2.

In order to achieve a favourable transmission ratio, the lever arm 23 of the triggering lever 4, which is able to move the lever arm 10 of the transmission lever 8, is long compared to the lever arm 10 of the transmission lever 8. The lever arm 23 of the triggering lever 4 is in FIG. 1 approx. 2 times as long as the lever arm 10 of the transmission lever 8.

The lever arm 11 of the transmission lever 8, which is able to move the pawl 2, is preferably long compared to the related physical effective length of the lever arm 22 of the pawl 2. In FIG. 1, this lever arm 11 of the transmission lever is approx. 1.5 times as long as the section of the lever arms 22 of the pawl 2 physically effective on the transmission.

Figure 2:
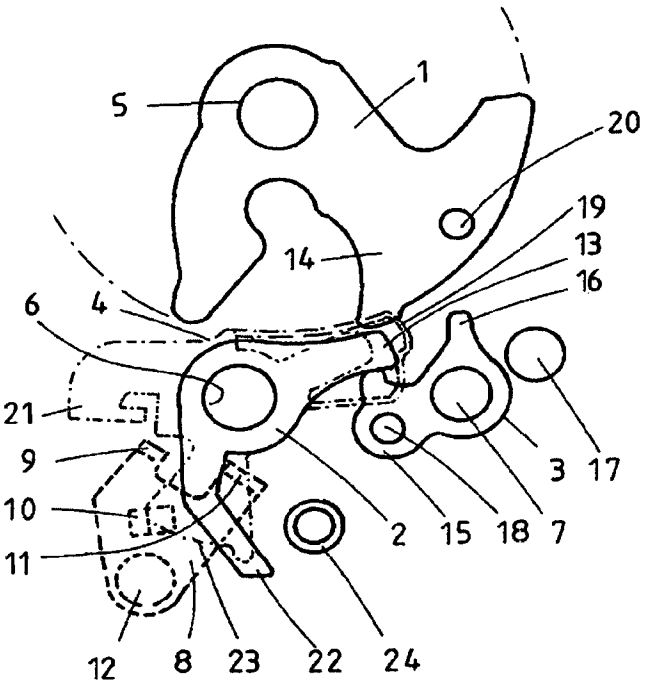
FIG. 2: shows a locking mechanism of FIG. 1 during opening.

FIG. 2 shows the opening of the locking mechanism with the aid of the follower 11. The transmission lever 8 has been pivoted in counter clockwise direction compared to FIG. 1 by the arm 23, resting against the end of the lever arm 10. The blocking lever 3 has been moved out of its blocking position by the triggering lever 4 and rests now with its lever arm 15 against the side of the lever arm 13 of the pawl 2. The follower 11 rests against the lever arm 22 of the pawl 2 and has moved the pawl 2 completely out of its detent position, as shown. The rotary latch 1 has already moved slightly in clockwise direction towards the opening position and can pivot freely. The locking mechanism is unlocked. The triggering lever 4 has pivoted the transmission lever 8 with the aid of the lever arm 10. The transmission has been chosen in such a way that the pawl 2 has been moved out of the engagement area of the rotary latch 1 with lever arm 10 and pivoted lever arm 11. The triggering lever 4 does in this case also no longer act on blocking lever 3. Blocking lever 3 is deflected further by pawl 3. This shows the gap between the pin 18 of the blocking lever 3 and the lever arm 19 of the triggering lever 4.

LIST OF REFERENCE NUMBERS

1: rotary latch
2: main catch pawl
3: blocking lever
4: triggering lever
5: rotary latch axis
6: common axis of pawl and triggering lever
7: blocking lever axis
8: transmission lever
9: lever arm of transmission lever
10: lever arm of transmission lever
11: lever arm of transmission lever
12: pivot axis of transmission lever
13: detent arm of pawl
14: engaging arm of rotary latch
15: blocking arm of blocking lever
16: lever arm of blocking lever
17: stop for blocking lever
18: pin of blocking lever
19: lever arm of triggering lever
20: pin of rotary latch
21: lever arm of triggering lever
22: lever arm of pawl
23: lever arm of triggering lever

The invention claimed is:

1. A lock for a door or panel for a motor vehicle or a building, the lock comprising:

a rotary latch;

a pawl comprising a detent, wherein the pawl is rotatable between two conditions, a closed condition in which the detent blocks rotation of the rotary latch relative to the detent and an open position where the rotary latch is rotatable relative to the detent;

a trigger lever rotatable in an opening direction and an opposite direction, wherein the pawl and the trigger lever are pivotally mounted on a common axis;

a stop that abuts the pawl when the pawl is in the closed condition and blocks further movement of the pawl away from the open condition and also abuts the trigger lever and defines a stop point when the trigger lever is rotated in the opposite direction; and a transmission lever comprising a follower, wherein the transmission lever is rotatable in a first direction and a second direction, wherein the trigger lever is adapted to contact the transmission lever and rotate the transmission lever in the first direction when the trigger lever is rotated in the opening direction, and wherein the follower is adapted to contact the pawl and rotate the pawl to the open position when the transmission lever is rotated in the first direction.

2. The lock according to claim 1, wherein rotating the trigger lever up to 20° is sufficient to completely move the pawl to the open position.

3. The lock according to claim 1, wherein rotating the trigger lever up to 16° is sufficient to completely move the pawl to the open position.

4. The lock according to claim 1, wherein rotating the trigger lever up to 14° is sufficient to completely move the pawl to the open position.

5. The lock according to claim 1, wherein moving the pawl to the open position required rotating the trigger lever at least 8°.

6. The lock according to claim 1, wherein moving the pawl to the open position required rotating the trigger lever at least 10°.

7. The lock according to claim 1, wherein moving the pawl to the open position required rotating the trigger lever at least 12°.

8. The lock according to claim 1, wherein the pawl further comprises a first arm that the follower contacts.

9. The lock according to claim 8, wherein a physically effective length of the follower is longer than a physically effective length of the first arm.

10. The lock according to claim 1, further comprising a blocking lever rotatable between two conditions, a blocking condition in which the blocking lever blocks rotation of the pawl while the pawl is in the closed condition and an unblocked condition where the pawl is rotatable relative to the blocking lever.

11. The lock according to claim 10, wherein the trigger lever further comprises a second arm adapted to contact the blocking lever and rotate the blocking lever from the blocking condition to the unblocked condition when the trigger lever is rotated in the opening direction.

12. The lock according to claim 11, wherein the trigger lever comprises a third arm that contacts the transmission lever.

13. The lock according to claim 12, wherein the transmission lever further comprises a fourth arm, wherein the fourth arm is adapted to contact the pawl to prevent bouncing of the locking mechanism.

14. The lock according to claim 10, wherein the rotary latch, the pawl and the blocking lever are located on a common plane.

15. The lock according to claim 14, wherein the triggering lever is located on a different plane than the common plane.

16. The lock according to claim 1, further comprising a transmission lever spring that biases the transmission lever in the second direction.

17. The lock according to claim 16, wherein the transmission lever further comprises a fourth arm that contacts the pawl and rotates the pawl to the closed condition when the transmission lever is rotated in the second direction.

18. The lock according to claim 17, wherein the pawl further comprises a first arm which contacts the follower, with the follower contacting a first side of the first arm, wherein the fourth arm contacts the first arm on a second side of the first arm opposite the first side.

19. A lock for a door or panel for a motor vehicle or a building, the lock comprising:

a rotary latch;

a pawl comprising a detent, wherein the pawl is rotatable between two conditions, a closed condition in which the detent blocks rotation of the rotary latch relative to the detent and an open position where the rotary latch is rotatable relative to the detent;

a blocking lever rotatable between two conditions, a blocking condition in which the blocking lever blocks rotation of the pawl while the pawl is in the closed condition and an unblocked condition where the pawl is rotatable relative to the blocking lever;

a trigger lever rotatable in an opening direction and an opposite direction, wherein the trigger lever comprises a first arm adapted to contact the blocking lever and rotate the blocking lever from the blocking condition to the unblocked condition when the trigger lever is rotated in the opening direction; and a transmission lever comprising a follower, wherein the transmission lever is rotatable in a first direction and a second direction, wherein the trigger lever is adapted to contact the transmission lever and rotate the transmission lever in the first direction when the trigger lever is rotated in the opening direction, wherein the follower is adapted to contact the pawl and rotate the pawl to the open position when the transmission lever is rotated in the first direction, wherein the trigger lever comprises a second arm that contacts the transmission lever and wherein the transmission lever further comprises a third arm adapted to contact the pawl to prevent bouncing of the locking mechanism.

20. A lock for a door or panel for a motor vehicle or a building, the lock comprising:

a rotary latch;

a pawl comprising a detent, wherein the pawl is rotatable between two conditions, a closed condition in which the detent blocks rotation of the rotary latch relative to the detent and an open position where the rotary latch is rotatable relative to the detent;

a trigger lever rotatable in an opening direction and an opposite direction;

a transmission lever comprising a follower, wherein the transmission lever further comprises an arm that contacts the pawl and rotates the pawl to the closed condition when the transmission lever is rotated in the second direction, wherein the transmission lever is rotatable in a first direction and a second direction, wherein the trigger lever is adapted to contact the transmission lever and rotate the transmission lever in the first direction when the trigger lever is rotated in the opening direction, and wherein the follower is adapted to contact the pawl and rotate the pawl to the open position when the transmission lever is rotated in the first direction; and a transmission lever spring that biases the transmission lever in the second direction.

* * * * *